United States Patent [19]

Cooper

[11] Patent Number: 4,565,958

[45] Date of Patent: Jan. 21, 1986

[54] AC LINE VOLTAGE REGULATOR WITH CONTROLLED ENERGY DISPENSER

[75] Inventor: Edward Cooper, San Diego, Calif.

[73] Assignee: Power-Matic, Inc., San Diego, Calif.

[21] Appl. No.: 573,493

[22] Filed: Jan. 24, 1984

[51] Int. Cl.[4] ..... G05F 1/38

[52] U.S. Cl. ..... 323/248; 323/319

[58] Field of Search ..... 323/235, 237, 242, 246, 323/247, 248, 257, 319, 323, 293, 209, 210, 249, 250

[56] References Cited

U.S. PATENT DOCUMENTS

| | | | |
|---|---|---|---|
| 2,838,729 | 6/1958 | Lovell et al. | 323/248 |
| 3,633,095 | 1/1972 | Hood | 323/319 |
| 3,662,216 | 5/1972 | Hildebrandt | 323/319 |
| 3,914,685 | 10/1975 | Van Gilder | 323/248 |
| 4,160,202 | 7/1979 | James et al. | 323/346 |
| 4,271,387 | 6/1981 | Mukai et al. | 323/246 |

*Primary Examiner*—Peter S. Wong
*Assistant Examiner*—D. L. Rebsch
*Attorney, Agent, or Firm*—Brown, Martin & Haller

[57] ABSTRACT

An AC line voltage regulator having a voltage sensing circuit for sensing and producing signals representative of the difference between a predetermined voltage level and the line voltage level and a load current sensing circuit for sensing and producing a signal representative of the magnitude of a load current drawn from the regulator. An actuation circuit combines the signals produced by the voltage and current sensing circuits to control the timing of a selectively switchable dispensing circuit which dispenses energy into an oscillatory circuit oscillating at the line voltage frequency and connected between input and output ports of the regulator. The dispensing circuit permits a selectable amount of energy to be dispensed in the oscillatory tank to adjust the line voltage level by adding the energy to either buck or boost the line voltage as determined by the difference signal. The magnitude of the dispensed energy is determined by combining the line voltage and load current signals to produce an activating signal, which permits the dispensing circuit to add energy at a predetermined rate for a period of time determined by the activation signal.

10 Claims, 9 Drawing Figures

AC LINE VOLTAGE REGULATOR WITH CONTROLLED ENERGY DISPENSER

BACKGROUND OF THE INVENTION

The invention relates generally to the control of AC line voltage, and more specifically to AC voltage regulation apparatus of the switching type.

The use of AC power to operate sensitive electrical and electronic equipment has given rise to a concomitant need to regulate the power in order to protect the equipment against sags or surges in the level of the line voltage provided by an AC power source. Over the years, equipment which uses AC power has become more sophisticated and now includes many computers and processor-based equipments having circuits which are extremely sensitive to variations in power supply level. Such circuits include, for example, volatile memories and high speed logic devices which require well-regulated voltages for reliable operation.

There is a plethora of apparatus available for regulation of AC power, but each apparatus has one or more characteristics limiting its use in modern power regulation applications. Such apparatus includes, for example, ferro-resonant or constant voltage transformers, line regulators, and line conditioners.

Ferro-resonant transformers utilize the magnetic saturation of a transformer core in a tank circuit which is intended to resonate at the power line frequency. Since a given core size of a transformer can be driven only to a certain maximum (saturation) flux density, it will limit, or regulate the output voltage. However, as is known, a ferro-resonant transformer utilizes a resonating tank which is sensitive to frequency transients and power factor loads. Furthermore, the output of such a transformer is current limiting in that the output voltage collapses when turn-on surges of equipment demand high charging currents. If a momentary drop-out occurs in the power input to a ferro-resonant regulator, the regulated output will collapse, and then recover over a number of input voltage cycles with unpredictable overshoots and undershoots of the resonating voltage level. The overshoots can exceed the nominal input line voltage and threaten critical equipment which depends upon the regulated voltage. Finally, the response time to small sags and surges in the input voltage level can consume many cycles of the line voltage.

Line regulators include phase-controlled regulators which utilize solid state switches to control the phase of the input line voltage during portions of the input sine wave to achieve a regulated output voltage. As is known, the regulated voltage waveforms produced by such devices can be severely distorted. Furthermore, since phase-controlled regulators do not regulate the peak voltage of the AC sine wave one must use caution in combining them with electronic equipments whose power supplies utilize peak rectifiers. A peak-clipping regulator absorbs the excess of the AC line voltage as the line voltage sine wave approaches its peak during each half cycle. However, such a regulator has poor efficiency, and its use is limited to low power applications because suitable high-power semiconductors are in limited supply.

AC line conditioners generally employ electronic circuits to compensate for any abnormality in an input AC line voltage waveform. However, the efficiency of such conditioners is poor, limited in many instances to about 35 percent. Another type of electronic regulator utilizes a tap switching technique wherein solid state switches connect a number of input and output taps on a transformer, and where an electronic control circuit compares either the input AC or the output regulated voltage against a reference to determine which of the solid state switches must be activated to obtain a semi-regulated output voltage. In such devices, there is always one solid state switch which must bear the full load current as well as inrush surge currents and overloads which can excessively stress presently available devices. Often, because of the deviation in phase between the AC input line voltage and the load current, several switching devices can be on simultaneously. Consequently, a short circuit can exist between two transformer taps with resultant currents which, at times, can exceed the current ratings of the switching devices. If the timing of the tap switching is controlled to occur at the time when the load current passes through zero, the simultaneous operation of several switching devices can be avoided, but the regulated waveform becomes severely distorted during switch-over. Further, tap switching devices typically have a limited number of taps which limits their ability to closely regulate an input voltage. For example, when the input voltage happens to be near the extreme end of a given range defined by one tap configuration, and the input voltage deviates from its regulated shape by a minute amount, the regulator output will then make a rather large step to the next range, resulting in a sudden surge or sag in the regulated waveform. Finally, as tap-switching regulators customarily utilize saturable transformers, excessive currents, threatening to the solid state switches, can be generated when such a transformer saturates.

Finally, a type of regulator employing a motor- or servo-variable transformer is known in which a feedback servo amplifier senses the regulated voltage and drives the servo to position the arm of the transformer in order to obtain the desired output voltage. However, the response time of such a servo circuit is extremely slow due to the mechanical inertia of the servo mechanism.

It is therefore desirable to have an AC line voltage regulator which can respond quickly to aberrations in the input line voltage caused by the generation of the voltage or by the provision of load current by the regulator.

SUMMARY OF THE INVENTION

The present invention is an apparatus for regulating an oscillating AC voltage, the apparatus having an input port for connecting to a source of sinusoidal AC line voltage and an output port for delivering an output sinusoidal AC voltage and a current to a load. A voltage sensing circuit is provided which is responsive to the level of either the line or output voltages for measuring the difference between the level of the sensed voltage and a preselected voltage level. The voltage sensing circuit provides signals which are representative of the difference. An activation circuit responds to the difference signal by providing an activation signal at a time which is determined by the difference signal. The activation signal stimulates an energy dispensing circuit, when the sensed voltage level differs from the predetermined level, to dispense energy into an oscillatory circuit which oscillates with the sensed voltage and which is connected between the input and output ports of the regulator. The dispensing circuit is selectively switched by the activation signal to dispense energy into the oscillatory circuit in such a direction as to either buck or boost the line voltage. The direction of energy dispensing is determined by a polarity characteristic of the voltage difference signal, and the amount of energy dispensed is determined by the magnitude of the voltage difference, both of which are indicated by the activation signal. The adjustment of the oscillation level in the oscillatory circuit in turn adjusts the level of voltage between the regulator ports and, thereby, the sensed voltage level.

A load current sensing circuit responds to a load current which flows between the regulator ports by producing a level signal representative of the magnitude of the load current. The current level signal is fed to the activation circuit where it is combined with the voltage difference signal to change the time when the activation signal is provided to the dispensing circuit. The change of time of the activation signal correspondingly changes the amount of energy provided by the energy dispenser to account for the effect of the load current on the level of oscillatory circuit oscillation.

It is therefore an object of this invention to provide a new and improved line voltage regulator.

It is another object of this invention to provide a new and improved method of regulating line voltages.

Other objects and many intended advantages of this invention will be more apparent upon reading of the following detailed description and examination of the drawings, wherein like reference numerals designate like parts throughout.

DESCRIPTION OF THE PREFERRED EMBODIMENT

Figure 1:
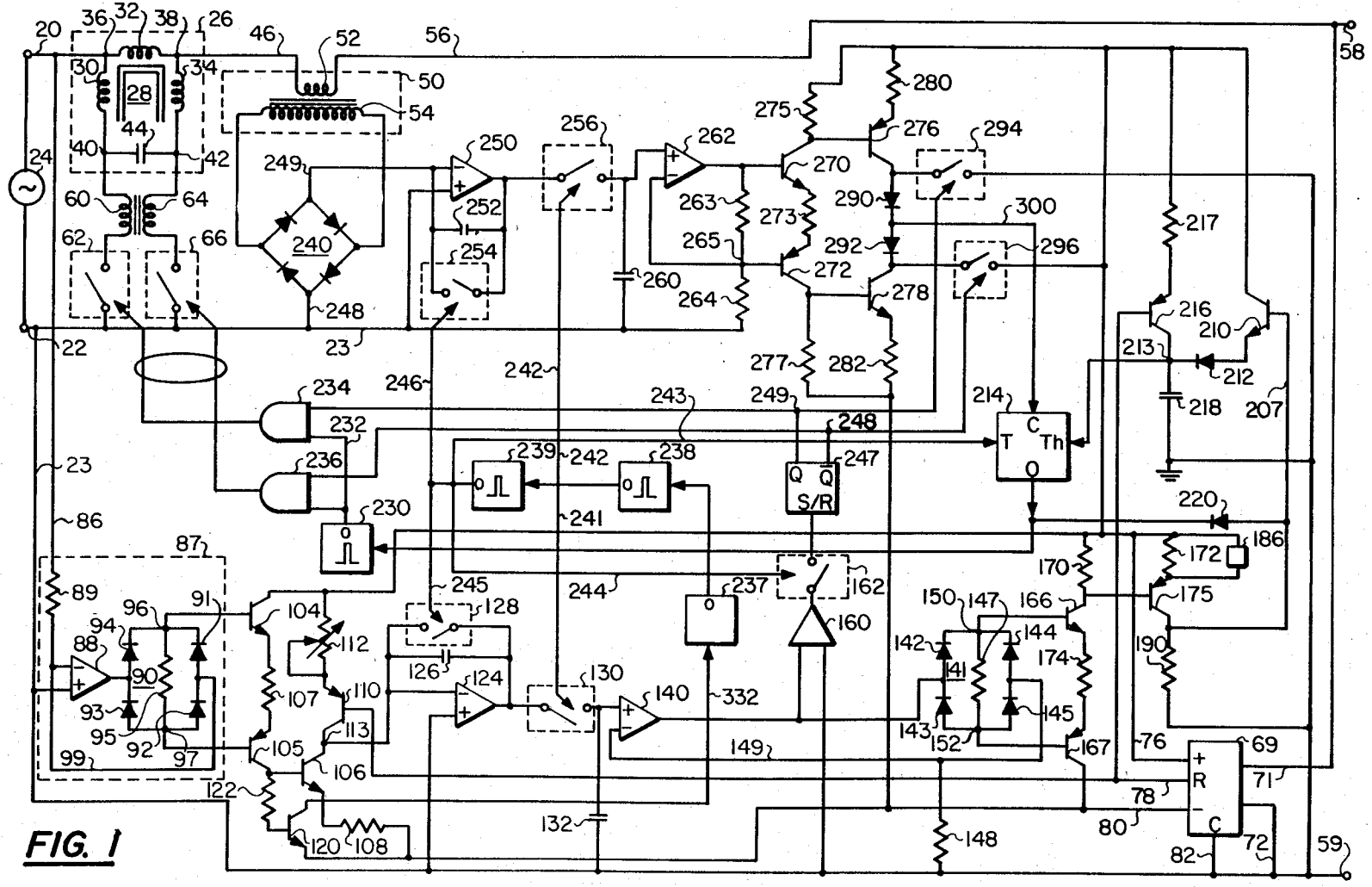
FIG. 1 is an overall schematic diagram of the embodiment of the line voltage regulator of the invention.

Referring now to FIG. 1, there is illustrated an apparatus for regulating an AC line voltage which has two input ports 20 and 22. The input port 22 is connected to a circuit common lead 23 which provides grounding for all of the components of the apparatus. A source 24 of sinusoidal AC voltage is connected across the input ports 20 and 22 to provide an input AC line voltage. It is to be understood that this invention is not limited to regulation of an input line voltage and the provision of an unregulated sinusoidal line voltage from the AC source 24 is merely illustrative of the operation of the regulation apparatus of the invention. The unregulated input line voltage is fed from the port 20 to an oscillatory tank circuit 26 which includes an autotransformer 28 having three windings 30, 32, and 34. The unregulated input line voltage is connected to the autotransformer 28 at the tap 36 which is positioned between the windings 30 and 32. Regulated line voltage is fed from the auto transformer 28 via tap 38 which is located between the transformer windings 32 and 34. The top and bottom taps of the autotransformer 28 are denoted by 40 and 42, respectively. A capacitor 44 is connected in parallel with the autotransformer 28 across the taps 40 and 42. The autotransformer 28 is selected for linearized inductance, similar to a choke, and thus, it forms a resonant tank circuit in conjunction with the capacitor 44, the resonant frequency being determined by the values of inductance and capacitance.

The regulated voltage, which is available from the tap 38, is fed on line 46 through a current sense transformer 50 having windings 52 and 54. The regulated voltage is connected on line 46, through the primary winding 52 of the current sense transformer 50, and therefrom on the line 56 to an output terminal 58. Another output terminal 59 is connected through the circuit common connection 23 to the input port 22. When the apparatus of FIG. 1 is used to regulate an input AC voltage, the ports 22 and 59 and the circuit common 23 are connected to the grounded neutral line of the AC voltage source 24. Such connection is standard and will be well understood by those familiar with the art of voltage regulation.

A switchable energy dispensing circuit which is useful for selectively dispensing energy into the oscillatory tank circuit 26, thereby to adjust the level of the input line voltage, includes an inductive choke 60 which is connected between the autotransformer tap 40 and one throughput port of a semiconductor switch 62. The other throughput port of the semiconductor switch 62 is connected to the circuit common lead 23. Similarly, a switchable energy path is provided from the autotransformer tap 42 through an inductive choke 64 and a semiconductor switch 66. The semiconductor switches 62 and 66 can comprise typical triggerable semiconductor power devices such as silicon-controlled rectifiers (SCR's) or thyristors.

The DC power which is necessary to operate the apparatus of the invention is provided by a typical DC power source 69 which includes a power transformer, not shown, connected through lines 71 and 72 between the output ports 58 and 59, respectively. The power supply 69 conventionally produces suitable operating voltages for operation of the voltage regulator of the invention, which include a positive DC voltage available on voltage line 76, a reference DC voltage available on voltage line 78, and a negative DC voltage available on voltage line 80. In addition, the power supply 74 has a common connection 82 to the circuit common lead 23.

A voltage sensing circuit, for sensing the difference between the AC line voltage to be regulated and a determinable reference voltage level, is connected to the input port 20 on signal line 86. The sensing circuit includes a full wave rectification circuit 87 having a conventional operational amplifier 88 into whose inverting terminal a sample of the unregulated AC line voltage is fed through a bias resistor 89. the non-inverting input of the operational amplifier 88 is connected to the circuit common lead 23. The amplified sample of the unregulated line voltage is provided from the output of the operational amplifier 88 to a full-wave rectification bridge 90 including diodes 91–94 which are conventionally connected to rectify the amplified line voltage sample and to provide the fully rectified sample on the resistor 95 connected between the rectification bridge nodes 96 and 97. The output of the rectifier bridge 90 is fed to the bases of a pair of transistors 104 and 105 which form a complementary differential current source. A resistor 107 is connected between the emitters of the complementary transistor pair. The collector of the transistor 104 connects to the positive voltage line 76 and the collector of the transistor 105 connects to the base of a current amplifying transistor 106. An emitter bias resistor 108 is connected between the emitter of the transistor 106 and the negative voltage line 80. A transistor 110 is connected to provide a source of constant current whose magnitude is directly related to and representative of the voltage level to which the AC line voltage is to be regulated. The magnitude of the constant current is set by an adjustable resistor or potentiometer 112 which is connected between the emitter of the transistor 110 and the positive voltage line 76. The collectors of the transistors 106 and 110 are connected in common at a summing junction or node 113.

The sensing circuit also includes a zero crossing detector consisting of a transistor 120 whose base is connected through a resistor 122 to the collector of the transistor 105 of the complementary pair. The emitter of the zero crossing detector transistor 120 is connected to the negative voltage line 80. It will be evident to those skilled in the art that the transistor 120 is utilized as a solid state switch that produces an output pulse whenever its base drive is reduced to zero.

The voltage sensing circuit further extends to an integrator that includes an operational amplifier 124 whose inverting port is connected to the input current summing node 113. The non-inverting input of the integrating operational amplifier 124 is connected to the circuit common lead 23, while a feedback capacitor 126 is connected between the output and the inverting input of the integrating amplifier 124. A switch 128, which can comprise any of a variety of known semiconductor switches, is connected to provide a discharge path for the capacitor 126 across the output and inverting input of the amplifier 124. Another semiconductor switch 130 is in series with the output of the integrating amplifier 124 and is connected to a sample-and-hold capacitor 132, which is also connected to the circuit common lead 23. Both switches are operated (closed) during the full duration of their respective control signals.

An operational amplifier 140, whose non-inverting port is connected to the sample-and-hold capacitor 132, forms the input section of another full wave rectifier circuit. The output of the amplifier 140 is connected to a conventional full wave rectification diode bridge 141 consisting of diodes 142–145. The output of the rectification bridge 141 is taken across a resistor 147 conventionally connected between the bridge output nodes 150 and 152. Feedback to the inverting input of the amplifier 140 is obtained from the node at the junction of the diodes 144 and 145 and is developed across the feedback resistor 148. The feedback signal is fed to the inverting input of the amplifier 140 on the feedback line 149. Thus, the operational amplifier 140, with the rectifier bridge and feedback network, constitutes a non-inverting amplifier with a very high input impedance.

A polarity difference comparator 160 has one input connected to the output of the amplifier 140 and the other to the common circuit line 23. Connected in this manner, the output of the comparator 160 will indicate the polarity of the output signal provided by the amplifier 140 referenced to the circuit common line 23. The comparator 160 can comprise any of a variety of available integrated circuits, for example, a type 710 voltage comparator. The output of the comparator 160 is connected to the input of the semiconductor switch 162.

The rectified positive output of the diode bridge 141 available at node 150 and the negative output at node 152 are connected to the bases of transistors 166 and 167, respectively. The transistors 166 and 167 form a complementary pair which operates in a manner similar to the pair consisting of transistors 104 and 105. A resistor 170 is connected between the collector of the transistor 166 and positive voltage line 76, and a resistor 174 is connected between the emitters of the transistor pair. The collector of the transistor 167 is tied to the negative voltage line 80. A sample of the current which flows through the complementary pair is fed to the base of a current amplification transistor 175 whose emitter is connected through a resistor 172 to the positive voltage line 76. The emitter of the current amplification transistor 175 also connects to a diode/resistor network 186, illustrated in greater detail in FIG. 2, which consists of a number, N, of parallel resistors, $R_1$–$R_N$. Connected between the resistors $R_1$–$R_N$ are an equal number, N, of diodes, $D_1$–$D_N$. A collector resistor 190 is connected between the circuit common 23 and the collector of the transistor 175. A signal lead 207 also connects the collector of the current amplification transistor 175 to the base of an emitter follower transistor 210.

An activation circuit which is responsive to signals produced by the voltage difference sensing circuit, and which responds to those signals by producing activation signals for selectively controlling the operation of the switching circuit described hereinabove consists of a diode 212 connected between the emitter of the emitter follower transistor 210 and, through a summation node 213, to the threshold (Th) port of a variable timer 214. The timer is preferably of the type designated 555, an example of which is the LM 555 available from National Semiconductor Corporation, Santa Clara, Calif. The timing network of the variable timer 214 consists of a constant current source transistor 216 and a timing capacitor 218. The emitter of the transistor 216 is connected through a resistor 217 to the positive supply line 76. As is known, the magnitude of the current flowing through the transistor 216 is set by the resistor 217. In addition, the base of the transistor 216 is connected to the reference voltage line 78, and its collector to the summation node 213. The timing capacitor 218 is connected between the summation node 213 and the circuit common lead 23. A clamp diode 220 joins the lead line 207 and the output port (O) of the variable timer 214. Port O of the timer 214 is also connected to the input port of the pulse generator 230, which can comprise, for example, a type 555 integrated circuit connected as a schmitt trigger. The output port (O) of the pulse generator 230 provides one input to each of two AND gates 234 and 236. The other inputs of the AND gates 234 and 236 are discussed in greater detail hereinbelow. As will be evident to one skilled in the art, whenever both inputs of the AND gate 234 are high, its output line will also be high which will then cause the switch 62 to turn on. The AND gate 236 similarly controls the operation of the switch 66. Thus, it should be evident that an activation signal controlling the operation of the energy dispensing network is provided on the output of either AND gate 234 or AND gate 236.

The activation circuit further includes a delay timer 237 whose trigger input is connected to receive a signal from the zero crossing detector transistor 120. The timer 237 can comprise an integrated circuit such as a type 555 which is connected as a schmitt trigger having a timing cycle which is equivalent to one-quarter of a period of the input line voltage. The output of the delay timer 237 connects to the trigger input of the pulse generator 238, the output of which is connected to the input of another pulse generator 239. Both the pulse generators 238 and 239 may be type 555 integrated circuits configured as schmitt triggers. The output of the pulse generator 238 is also connected via signal line 241 to the control input of the switch 130 which is connected between the integrating amplifier 124 and the sample and hold capacitor 132. The control line 241 activates the switch 130 at the leading edge of the pulse which is output by the pulse generator 238. The output of the pulse generator 238 is also provided on the output line 242 for purpose described hereinbelow. The output of the pulse generator 239 is provided on signal lines 243–246, with the signal line 243 connected to the trigger input of the variable timer 214, the signal line 245 connected to the control input of the semiconductor switch 128, and the signal line 244 connected to the control input of the semiconductor switch 162.

The activation circuit further includes a polarity signal latch consisting of a flip-flop 247 which has two complementary logic outputs illustrated as Q (available on signal line 249) and $\overline{Q}$ (available on line 248). As is illustrated, the outputs of the polarity latch flip-flop 247 provided the other inputs for the AND gates 234 and 236, with the Q output going to the gate 234 and the $\overline{Q}$ output going to the gate 236. The presetting input (S/R) of the flip-flop is connected to receive the output of the comparator 160 through the switch 162.

The level of the current drawn by a load which is connected between the output ports 58 and 59 of the regulator is sensed by a circuit whose front end consists of the current sense transformer 50. The current drawn by the load flows from the output tap 38 of the resonant circuit 26, through line 46, primary winding 52, and output line 56. The transformer 50 has a secondary winding 54 which is connected across a conventional full wave rectifier 240 consisting of four diodes connected in the well-known bridge configuration. The rectified output is terminated to the circuit common lead 23 through connection 248 and connects, through line 249, to the inverting input of an operational amplifier 250. The operational amplifier 250 is connected as an integrating amplifier similar to the integrating amplifier 124 described above. The integrating amplifier 250 has its non-inverting input connected to the circuit common lead 23. An integrating feedback capacitor 252 is connected between the non-inverting input and the output of the amplifier 250, and a semiconductor switch 254 is connected across the capacitor 252 to discharge it when the switch is activated by a signal on the signal line 246, connected to the output of the pulse generator 239. The output of the integrating amplifier 250 feeds a sample-and-hold circuit consisting of a semiconductor switch 256, controlled by the output of the pulse generator 238 on line 242, and a sample-and-hold capacitor 260 which is connected between one terminal of the switch 256 and the circuit common lead 23.

The voltage held on the capacitor 260 is fed to the non-inverting input of a conventional operational amplifier 262. The operational amplifier 262 is connected in standard non-inverting feedback form with the feedback signal developed across the resistors 263 and 264. Feedback to the inverting input of the amplifier 262 is provided from the node 265 between the resistors 263 and 264.

A complementary transistor pair consisting of transistors 270 and 272 forms a differential current source with a resistor 273 connected between the emitters of the pair. The collector of the transistor 270 connects through the resistor 275 to the positive voltage line 76, while the collector of the transistor 272 is connected through the resistor 277 to the negative voltage line 80. The base of the transistor 270 is connected to the output port of the amplifier 262, and the base of the transistor 272 to the feedback node 265. The transistor pair 270 and 272 feeds another complementary transistor pair consisting of transistors 276 and 278. The base of the current transistor 276 obtains current from the collector of the transistor 270 while its emitter is connected through a resistor 280 to the positive voltage line 76. Similarly, base current for the transistor 278 is obtained from the collector of the transistor 272 while the emitter of the transistor connects through the resistor 282 to the negative voltage line 80. The collectors of the transistors 276 and 278 are connected through two diodes 290 and 292. The anode of the diode 290 is connected through a semiconductor switch 294 to the circuit common lead 23. The semiconductor switch 294 has its control lead connected to the Q output of the polarity latch flip-flop 247. The cathode of the diode 292 is connected through another semiconductor switch 296, controlled by the $\overline{Q}$ output of the polarity latch, to the positive voltage line 76. The connection between the cathode of the diode 290 and the anode of the diode 292 feeds the control (C) port of the variable timer 214.

When activated, the semiconductor switch 294 shunts the collector current of the transistor 276 to the circuit common and reverse-biases the diode 290. Correspondingly, when the switch 296 is activated, the collector current of the transistor 278 is shunted to the positive voltage lead 276, and the diode 292 is reverse-biased.

The circuit illustrated in FIG. 1 constitutes a tank circuit with a controlled energy dispenser which can regulate AC line voltages with an extremely fast response time. With reference to FIG. 1, the operation of the circuit can be understood.

Assuming that a sinusoidal AC line voltage is applied between the input terminals 20 and 22, with the live line voltage of the power line connected to terminal 20 and the grounded neutral of the same power line to terminal 22, the input voltage connects through the winding 32 of the transformer 28. The winding 32 constitutes a buck/boost winding. Energy is dispensed into the tank circuit 26 and induced into this winding in such a manner as to be added, to boost, or subtracted from (buck) the input voltage. The resulting net, or regulated voltage appears at the output tap 38 and connects from there through the primary winding 52 of the current sense amplifier 50 to the output terminal 58.

The operational amplifier 88 and rectifier bridge operate conventionally to rectify the sample of the input AC line voltage which is connected through the resistor 89. As is typical, the polarity of the current flowing through the resistor 95 is always the same, with node 96 always being positive with respect to node 97. It will be appreciated that the current flowing through the resistor 95 develops a voltage that is a train of full-wave rectified half cycles of the input AC line voltage, each half cycle directly portional to the corresponding half cycle of the input sine wave.

The rectified voltage produced by the bridge 90 connects to the two bases of the complementary current transistors 104 and 105. The rectified input voltage causes current to flow through both transistors which is proportional to the amplitude of the AC line voltage, but which is rectified. The collector current of the transistor 105 is sampled across the resistor 122 and, since this current is a rectified half wave, there is a period of time at the beginning and end of each AC line voltage half cycle where this current reduces to zero. With the current at zero, the zero crossing detector transistor 120 switches to an off state which is coincident with the zero crossing of the AC line voltage. This switching action is utilized to trigger the delay timer 237 synchronously with every zero voltage crossing of the input voltage sine wave, which occurs twice during each cycle.

The delay timer 237 has a fixed timing period of slightly less than one-quarter of a cycle of the input sine wave. When the period ends, the timer 237 provides a trigger input to the pulse generator 238. When the pulse generator 238 is activated, it operates to close the two switches 130 and 256 and to trigger the pulse generator 239. As is illustrated below, the pulse timing is such that the leading edge of the pulse supplied by the generator 239 occurs virtually simultaneously with the falling edge of the pulse output by the generator 238. The second pulse generator 239 operates the three switches 128, 162, and 254; it also provides a trigger input for the variable timer 214. Thus, an overall timing sequence is established which consists of a successive train of delay impulses, all synchronized to repeat with each half cycle of the input AC line voltage. In the preferred embodiment, the total time period from the zero crossing to the leading edge of the pulse from the generator 239 is designed to consume one-quarter cycle of the input line voltage sine wave.

Returning to the operation of the voltage sampling circuit, the rectified half wave current sampled across the resistor 122 provides an inut voltage to the base of the transistor 106, which amplifies the rectified full-wave current that is directly proportional to the input sine wave. This amplified current is fed to the summing junction 113 wherein it is combined with the constant current provided by the transistor 110. Thus, there are two indpendent currents flowing into the summing junction 113, one of them being a continuous DC current, and the other a rectified sinusoidal current. The two currents are summed at the node and the net result is provided as an input current to the integrating amplifier 124.

In the operation of the integrating amplifier 124, the switch 128, when activated, short-circuits the output of the integrator back to the summing junction 113 and discharges the capacitor 126 to zero. As was described above, the switch 128 is operated by the pulse generator 239 which provides a pulse at each one-quarter point of the input voltage sine wave where it passes through its peak. Thus, the integrator is reset to zero by the switch 128 at the 90° and 270° of the input sine wave, or twice each cycle. Since the amplifier 124 is integrating the difference between a continuous DC current and a rectified sinusoidal wave its output consists of a sine wave of a frequency that is exactly twice that of the input sine wave. This is well-known process of analog frequency doubling. As is conventional, if the RMS values of the two input currents are equal, the sine wave at the output of the integrating amplifier 124 after one-half cycle of the input sine wave will have a magnitude equal to that when it was being reset by the swtich 128, that is, zero. On the other hand, if the RMS values of the two currents are unequal, the integrator output will be either positive or negative after the same half-cycle timer period, depending upon the relative magnitudes of the currents flowing at the summing junction 113.

It should now be evident that it is possible to adjust the level of the current flowing through the transistor 110 by operation of the variable resistor 112 to provide any desired reference level which can be compared with the rectified current provided by the pair of transistors 104 and 105. Since the current is proportional to the voltage at the emitter of the transistor 110, it effectively corresponds to a voltage level. It should be evident therefore that the level of transistor 110 collector current can be calibrated to a predetermined voltage level which regulates the level of the input AC voltage.

The deviation of the input voltage waveform, as represented by the rectified current, from the level determined by the setting of the adjustable resistor 112 can be detected by the action of the integrating amplifier 124, which effectively constitutes a voltage error detection circuit whose output corresponds to the difference between the predetermined and input voltage levels. Since the switch 128 is being operated in half cycle intervals, and since the instantaneous voltage level and polarity at the integrator output, when measured just prior to the resetting of the switch 128, form an accurate measurement of the input AC line deviation from the reference, it should be obvious that this portion of the voltage sensing circuit can make high speed AC voltage measurements in half-cycle intervals.

The switch 130 which is connected to the output of the integrating amplifier 124 and operated by the pulse generator 238 samples and holds the absolute error voltage measurement of the amplifier 124 just prior to the resetting of the switch 128. When the switch 130 is activated, it will transfer whatever voltage and polarity condition exist at the output of the amplifier 124 to the sample-and-hold capacitor 132, charging or discharging the capacitor virtually instantaneously. Thus, the error condition that existed at the output of the integrating amplifier 124 just prior to its being reset is stored by the capacitor 132 and is connected therefrom to the input of the non-inverting operational amplifier 140. As is known, in the non-inverting configuration, the feedback voltage of the amplifier 140 is in phase with its input voltage, and the amplifier presents a very high input impedance to the input signal which will cause the voltage held on the capacitor 132 to be stored there until the switch 130 is activated on the succeeding half-cycle zero crossing, at which time the capacitor voltage will be altered if the input voltage level varies from the voltage level represented by the level of the current through the transistor 110. The voltage which is stored on the capacitor 132 is amplified by the amplifier 140 and reproduced at its output as a low impedance voltage which is directly proportional to the stored charge, and thus to the deviation of the input voltage from the predetermined level.

The output of the operational amplifier 140 is rectified by the bridge circuit 141 in which the node 150 is always positive with respect to the node 152 so long as there is an input voltage error. The voltage developed across the resistor 147, referred to below as the absolute voltage error, will always be of the same polarity because of the resistor's location in the bridge 141. Thus, the input voltage error which is stored on the sample-and-hold capacitor 132 has a voltage with a polarity sense which is converted by the bridge circuit 141 into the absolute voltage error that appears across the resistor 147. The magnitude of the voltage which is developed across the resistor 147 is a direct function of the ratio of the two resistors 147 and 148. In the preferred embodiment, the resistors 147 and 148 have equivalent resistance values so that the magnitude of the voltage across the resistor 147 will equal the magnitude of the voltage in the capacitor 132.

The input error voltage which is detected each half cycle and amplified by the amplifier 140 is also connected to one input of the voltage comparator 160. As the comparator compares this voltage against the circuit common lead 23, its output provides a logic output state which depends upon whether the error voltage is positive or negative with respect to the circuit common. Stated differently, the voltage error polarity will be positive when the input voltage level exceeds the predetermined level, and negative when it is less than the predetermined level. Thus, the polarity of the difference between the input voltage and the predetermined level is detected and provided as an output by the comparator 160. The output of the comparator 160 connects through the switch 162 whence it is latched once each half cycle into the polarity latch flip-flop 247.

The absolute error voltage developed across the resistor 147 provides a voltage input to the two bases of the complementary pair of transistors 166 and 167. Thus, the current through the transistor pair is directionally proportional to the absolute input voltage error. This proportional current flows from the collector of the transistor 166 through the resistor 170 which develops a voltage proportional to the absolute voltage error. This proportional voltage is connected to the base of the current transistor 175 whose collector current flows through the sampling resistor 190. The current in the collector of the transistor 175 is directly proportional to the absolute value of the magnitude of deviation of the AC input voltage from the desired nominal voltage. It should also be evident that, when the input voltage equals the desired voltage level, the collector current of the transistor 175 will be zero.

The voltage developed on the register 190 results from the interaction of the transistor 175 and the network 186 as described below; it is provided on the line 207 which connects to the base of the emitter follower 210 and to the anode of the clamp diode 220. This voltage, which corresponds to the absolute error voltage, is used to control the timing operation of the variable timer 214.

As is conventional, the timing network of the timer 214 consists of the capacitor 218 and a constant current source, transistor 216. Once the timer 214 is triggered by the provision of an output pulse from the generator 239, the timing network will produce a linear ramp which starts from zero and rises until it exceeds a control or reference voltage which is generated internally by the timer 214. When that reference level is exceeded, the voltage level at port O of the timer 214 changes state, which triggers the operation of the pulse generator 230. As is also conventional, during the time when the capacitor 218 is charging the output of the timer 214 is high, and at the end of the period, when the voltage level on the capacitor 218 equals the interior reference level, the output drops, where it stays until the timer 214 is once again triggered. So long as the signal at port O of the timer is low, the clamp diode 220 is forward biased which diverts base current from the emitter follower 210 and keeps it turned off.

The value of the capacitor 218 and the magnitude of the current provided by the current source 216 are selected to provide a timing period for the timer 214 which is slightly less than the time consumed by one-quarter cycle of the input line AC line voltage sine wave. Since the timer 214 is triggered by the negative edge of the pulse output by the pulse generator 239 which occurs just after the peak of each input sine wave half cycle, the output of the timer 214 will fall just before the input voltage sine wave traverses through zero voltage. However, if the emitter follower 210 causes an initial charge to be placed on the capacitor 218, it should be evident that the timing period of the timer 214 will be shortened. This provides a means for controlling the transition in the output of the timer 214 which can be positioned at any time between a peak of the input voltage sine wave and the next following zero crossing, that is, between the 90° and 180° points and between the 270° and 360° points of the input voltage sine wave. When the timer 214 times out, its falling output triggers the pulse generator 230, whose output is guided as an activation signal to either switch 62 or switch 66 by gate 234 or 236, depending upon the polarity of the difference signal detected by the comparator 160. Therefore, it should be evident that the activation signal can be provided to the switching circuit at any point in the second or fourth quarters of the input voltage sine wave.

The activation signal is guided to one or the other of the switches 62 and 66 through the action of the AND gates 234 and 236 under the control of the polarity latch flip-flop 247. In the preferred embodiment, if the input voltage level is less than the predetermined level, the Q output of the flip-flop 247 will be set high, and if the input voltage is greater than the predetermined nominal level, the $\overline{Q}$ output will be set high. Assuming Q has been set high, it enables the AND gate 234 which, when the timer 214 times out, is caused by the pulse generator 230 to provide a high output for so long as the output of the generator remains high. The high level output by the gate 234 activates the switch 62.

When the switch 62 is turned on, it connects the tank circuit 26 to the circuit common line 23 through the choke 60. This provides a current path from the input terminal 20 through the autotransformer tap 36, the winding 30, the choke 60, and the switch 62 to the circuit common line 23 and the input terminal 22. Preferably, the switch 62 is an SCR type such as a triac which will start conducting current and latch itself into conduction until the current through it decreases below some minimum holding level. However, current will be available to flow through the switch 62 only if the input sine wave is at some non-zero level. Thus, if the pulse of the generator 230 occurs after the maximum time-out of the timer 214, that is, at a zero voltage crossing of the input sine wave, there will be no voltage between the terminals 20 and 22, and consequently the switch 62 will not latch. On the other hand, if the timer 214 times out at a point which is advanced by the presetting of the timing capacitor 218 from the emitter follower 210, the activation pulse from the AND gate 234 will activate the switch 62 at some non-zero point between the peak of the input sine wave and its next following zero crossing.

Similarly, if the input voltage is larger than the predetermined nominal level, the comparator 160 will set the polarity latch flip-flop 247 so that its $\overline{Q}$ output will be high. When the $\overline{Q}$ output of the flip-flop 247 is high, it enables the AND gate 236 to provide an activation pulse to the switch 66 when the generator 230 produces an output pulse. In this case, a current path exists from the input terminal 20 through the autotransformer tap 36, the buck/boost winding 32, the winding 34, the choke 64, the switch 66 to the circuit common 23 and the input port 22. Therefore, it can be seen that the timing of the activation signal provided to the switching circuit is determined by the absolute magnitude of the measured input voltage error and that the particular switching configuration of the energy dispensing circuit is dependent upon the polarity of the difference.

As described hereinabove, the autotransformer 28 forms an oscillatory tank circuit with the capacitor 44. The autotransformer 28 is selected for linearized inductance, thus, any energy which is dispensed into the tank 26 will cause the tank to resonate, with the amplitude of the first half cycle of the oscillating wave being a function of the amount of energy dispensed into the tank by virtue of its connection between the input ports 20 and 22. If energy is dispensed into the tank 26 only once, it will cause a ringing wave in the tank which decays like a damped oscillation. On the other hand, if the dispensing of energy into the tank is repeated during each half cycle of the input sine wave, the tank will oscillate with controlled amplitude at the frequency of the input sine wave. It should be evident that the energy which is dispensed into the tank 26 is due to the current which flows into it either through winding 30 when the switch 62 is turned on, or the current which flows through the winding 34 when the switch 66 is turned on.

It should be noted that, regardless of which of the switches 62 or 66 is turned on, there is always an inductive choke in series with the switch, choke 60 or 64, respectively. As is known, the series choke will cause the activated switch to remain on so long as the current through it flows in the same direction, and until that current decreases below some finite, threshold level. As will be understood from the principles of AC circuit theory, the current through either of the chokes 60 and 64 will be 90° out of phase with the voltage which induces it so that the maximum current through the choke will occur when the line voltage sine wave passes through zero. After the line voltage sine wave has passed through zero and begins to rise toward the next, opposite voltage peak, the current through the choke will continue to flow in the same direction, decreasing toward zero, and reaching zero at the time when the line voltage waveform has reached its opposite peak.

It should now be obvious that, if one of the switches 62 or 66 is being triggered on at a given time with reference to a particular zero voltage crossing of the input line voltage sine wave, that device will conduct maximum current at the time that the input voltage waveform crosses through zero, and the switch will continue to conduct current in the same direction until the input sine wave reaches the same amplitude—of opposite polarity—as it was at the time the switch was triggered on. In the extreme case, if the switch is triggered at every peak of the input voltage sine wave, it will conduct over an angle of essentially 180° for each such triggering. Thus, an activation signal range which spans the second and fourth quadrant of the input voltage sine wave can cause the switches to conduct over any portion of the input sine wave, that is from 0° to 360°. Thus, the magnitude of the energy which is dispensed into the tank circuit 26 can be controlled over a wide range by controlling the time at which the activation signal is provided, which essentially controls the firing angle of the switches. This time is determined by the presetting of the variable timer 214 by the magnitude of the voltage error which is provided through the emitter follower transistor 210.

As is evident from inspection of FIG. 1, the winding 32 of the autotransformer 28 forms a part of the tank circuit 26. The oscillating voltage which appears across this winding is a function of the ratio established by the number of turns of this winding to the total number of turns on the autotransformer 28. Therefore, the oscillating voltage appearing on the winding 32 is a function of the magnitude of the ringing wave which exists in the tank circuit 26. In turn, the oscillatory tank circuit wave is a function of the energy dispensed into the tank circuit 26 through either of the switches 62 or 66. Preferably, the winding relationship between the three windings on the autotransformer 28 is such that, when the switch 62 is conducting, the oscillating voltage induced into the winding 32 will be in phase with the input line voltage sine wave. Since the input line voltage is connected through the tap 36 and the winding 32 to the output tap 38, conduction through the switch 62 will produce a stepped-up output voltage, which will boost the magnitude of the input line voltage. On the other hand, if the switch 66 is conducting, it will cause a reduced, a bucked output at the output tap 38. Thus, the output voltage which appears on the autotransformer tap 38 can be adjusted by being boosted or bucked to become a well-regulated AC voltage which can be obtained across the output ports 58 and 59. As will now be explained, the degree, or quality of the input line voltage is a function of the diode/resistor network 186, which is illustrated in greater detail in FIG. 2.

The network 186 consists of a number, N, of resistors and an equal number of, N, of diodes which are arranged so that they form a non-linear emitter load for the current source transistor 175. As was explained above, the current transistor 175 provides a collector current which is directly proportional to the voltage error measured by the integrating amplifier 124. When the error is zero, the output current from the current source transistor 175 is also zero. As the input error measured by the integrating amplifier 124 increases, the current from the current source transistor 175 will increase proportionally. However, as the current from the transistor 175 increases, the impedance presented by the parallel combination of the network 186 and the resistor 172 changes in a non-linear fashion by activating an increasing number of diodes and resistors, as the voltage across the resistor 172 increases. This characteristic can be understood with reference to FIG. 2 wherein the voltage over the emitter resistor 172 which is developed by the flow of emitter current, Ie, therethrough from the emitter of the transistor 175 causes the diode $D_1$ to switch on which places the resistor $R_1$ in parallel with the emitter resistor 172, thereby lowering the emitter resistance of the transistor 175. As is evident from FIG. 2, the collector current through the transistor 175 and the voltage on line 207 increases in a non-linear fashion with linear increases of error voltage provided by the voltage sensing circuit as an increasing number of the resistors $R_1$–$R_N$ are switched on by the successive forward biasing of the diodes $D_1$–$D_N$.

The voltage provided on line 207 will not activate the emitter follower transistor 210 until the timer 214 is triggered on, at which time the clamp diode 220 will be reverse biased by the change in the output of the timer 214. At this time, the emitter follower transistor 210 will be turned on and will provide an initial charge to the capacitor 218. This, of course will cause the preset of the capacitor 218 to become non-linear with respect to linear increments of input voltage error. This nonlinearity, however, can be designed to compensate for the sinusoidal shape of the input voltage which is being utilized to dispense energy into the tank circuit 26. By choosing a suitable network for this compensation, it is possible to dispense non-linear increments of increasing energy into the tank circuit 26 so that the resulting buck or boost voltage induced in the winding 32 will become directly proportional to the input voltage deviation, resulting in a smooth output voltage regulation.

As described thus far, the apparatus constitutes a voltage regulator which provides no compensation for the effects of a load current which will cause a current to flow through the buck/boost winding 32 of the autotransformer 28. It should be evident that any load current which flows through this winding will excite the tank circuit 26 and cause it to resonate. The amplitude of the resonating wave thus induced is proportional to the magnitude of the load current, and it may either aid or oppose the resonating wave which is induced into the tank through the energy dispenser switches 62 or 66. Therefore, the load current sense circuit described above is included in this apparatus to measure the load current, and to correspondingly compensate for the dispensing of energy into the tank circuit 26 which might otherwise be induced by the current.

The load current which flows through the output port 58 is sensed by the transformer 50. The load current flows through the primary winding 52 and produces a corresponding current in the secondary winding 54 that is proportional to the input current as determined by the turns ratio between the two windings. The winding 54 connects to the full wave rectifier 240, and the rectified current is fed to the inverting input of the integrating amplifier 250. This integrating amplifier operates identically to the voltage error integrating amplifier 124, except that the amplifier 250 integrates the load current. The reset switch 254, which is operated by the pulse generator 239 once during each half cycle just after the peak of the input voltage sine wave, causes the integrating amplifier 250 to repeat its action in half cycle intervals. If any load current is flowing through the winding 52 of the current sense transformer 50, it will appear as a voltage at the output of the integrating amplifier 250 before the reset switch 254 is activated. It should be evident that this voltage is directly proportional to the magnitude of the load current.

The output of the integrating amplifier 250 is sampled by the combination of the switch 256 and sample-and-hold capacitor 260. The sampling occurs once each half cycle of the input voltage sine wave as a result of the pulse produced by the pulse generator 238. It should be recalled that the pulse generator 238 produces the pulse just prior to the generator 239 and that this pulse is coincident with the peak of each half cycle of the input voltage sine wave. Thus, the capacitor 260 will store a voltage that is directly proportional to the current drawn by the load just prior to the reset action. This voltage will be updated in half cycle increments. The operational amplifier 262 amplifies voltage stored on the capacitor 260 and provides the amplified voltage on its output to a divider network including the resistors 263 and 264. Preferably, both resistors have the same value so that the voltage developed across the resistor 263 will be the same as the voltage stored on the capacitor 260. Therefore, the voltage developed over the resistor 263 will be proportional to the current drawn by a load.

The voltage developed across the resistor 263 is applied to the bases of the two transistors 270 and 272 which constitute a complementary current source through which a current proportional to the load current flows. Since this proportional current flows through the resistors 275 and 277, voltages which are proportional to the load current will be applied by these resistors to the bases of the transistors 276 and 278, respectively. The transistor 276 constitutes a current source providing a current which is proportional to the load current and which is referenced to the positive voltage line 76. Correspondingly, the transistor 278 provides a collector current which is proportional to the load current but which is referenced to the negative voltage line 80. A described above, the switches 294 and 296 are connected to the collectors of the transistors 276 and 278, respectively. These switches are activated differentially by the action of the polarity latch flip-flop 247; thus, only one is activated during any half cycle of the input voltage waveform. When activated, the switch 294 bypasses current from the transistor 276 to the circuit common line 23 and reverse-biases the diode 290, which will cause current to flow from the control input line 300 which connects to the control (C) port of the variable timer 214. The switch 296, when activated, bypasses current from the transistor 278 to the positive power supply line 76 and reverse-biases the diode 292 which diverts any current flowing through the diode 290 into the control input line 300.

It will be recalled from the above description that the switches 294 and 296 are operated in a complementary manner by the outputs of the polarity latch flip-flop 247. Thus, while one of the switches is on, the other one will be off. Since the flip-flop 247 is controlled by the voltage comparator 160, the logic state of the flip-flop 247 represents a decision that energy will be dispensed in the tank circuit 26 in a direction which either bucks or boosts the input line voltage when the variable timer 214 times out.

Figure 3:
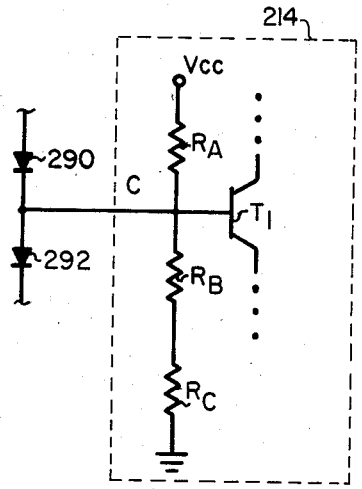
FIG. 3 is a partial schematic diagram of one input port of a variable timer used in the activation circuit of the invention.

The control of the switches 294 and 296 is such that the switch 294 will be activated when the boost mode of operation is the next following function selected by the switch circuit. Therefore, the switch 296 will be open, permitting current to flow the collector of the transistor 278, through the diode 292 over the control line 300 from port C of the timer 214. As is known, the C port of a 555 timer feeds a voltage divider network having a structure illustrated in FIG. 3. As shown, current will be injected into or diverted from the resistor divider comprising resistors $R_A$, $R_B$, and $R_C$. This will vary the base voltage of the transistor $T_1$ which is effectively the reference voltage which determines the level to which the voltage on the timing capacitor 218 must ascend in order to time out the timer 214 and cause it to change state.

By shifting the voltage level at port C of the timer 214 either upward or downward, it is possible to change the reference voltage level so that the timing ramp reaches the level, and times out, either sooner or later. Opening switch 296 (operating the switching circuit to boost the input voltage level) and at the same time closing the switch 294 will reverse bias the diode 290 and cause current to flow from port C of timer 214 through the transistor 278. As is evident with reference to FIG. 3, this will lower the reference voltage at the base of the transistor $T_1$ and cause the timer 214 to time out sooner. This will, in turn, cause the generator 230 to provide a pulse which will enable the AND gate 234 to advance the output of an activation signal to the switch 62. This, in effect, reduces, the firing angle and increases the conduction period of the switch 62, thus, dispensing more energy into the tank circuit 26. Contrastingly, when the switch 296 is closed and the switch 294 is open (that is, when the switching circuit is set to dispense energy in the tank circuit 26 in a direction which bucks the input voltage level) current will flow from the current transistor 276 through the steering diode 290 and into port C of the timer 214. This will raise the base voltage on the transistor $T_1$ thus, increasing the time-out threshold which the capacitor 218 must achieve in order to switch the output of the timer 214. Under these circumstances, the variable timer 214 will time out later and the pulse generator 230 will provide the gating pulse later to the AND gate 236 which will cause the switch 66 to fire later and conduct for a shorter period of time, thus dispensing less energy into the tank circuit.

It will be obvious that any load current which flows through the autotransformer winding 32 opposes the current which flows into the tank circuit 26 through the winding 30 when the switch 62 is conducting. Similarly, the load current aids the energy dispenser if the switch 66 is conducting since, in that case, both currents flow the same direction through the winding 32. Hence, it should be evident that, in the first case, it is desirable to turn on the switch 62 earlier than would be indicated by the magnitude of the error voltage, because of the effect of the load current. In the same vein, it is desirable to delay the firing of the switch 66 when a load current is flowing. Thus, by shifting the point at which the variable timer 214 changes state in response to the magnitude of a sensed load current, it is possible to advance, or to delay the triggering of the energy dispense switches 62 and 66 by an amount which will cancel the effect of the load current on the tank circuit 26.

Figure 4:
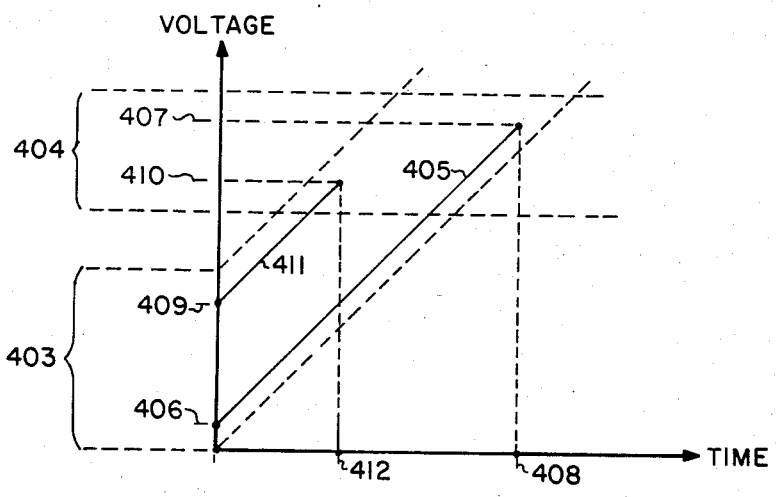
FIG. 4 is a diagrammatic illustration of the operation of the variable timer used in the activation circuit to produce an activation signal.

The operation of the variable timer 214 is shown graphically in FIG. 4 wherein the horizontal axis represents the time at which the output at port O of the timer 214 changes state, and the vertical axis represents the magnitude of the voltage on the timing capacitor 218. A bracket 403 encompasses a representative range of preset levels to which the timing capacitor 218 can be charged by the emitter follower transistor 210. A second bracket 404 spans a representative range of reference levels that can be established at port C of the timer 214 to set the magnitude of voltage to which the capacitor 218 must charge in order to cause the timer 214 to change its output state. For example, a timing ramp 405 represents the build-up of voltage on the timing capacitor 218. If the capacitor is initially charged to a voltage level 406 and another voltage level 407 is set as the reference level, the duration of the timing pulse which is output at port 0 of the timer 214 is represented on the time axis by point 408. Similarly, if the capacitor 218 is initially charged to a voltage level 409 and the reference voltage level is 410, the timing slope 411 will cause a change of state to occur at time 412.

Figure 5:
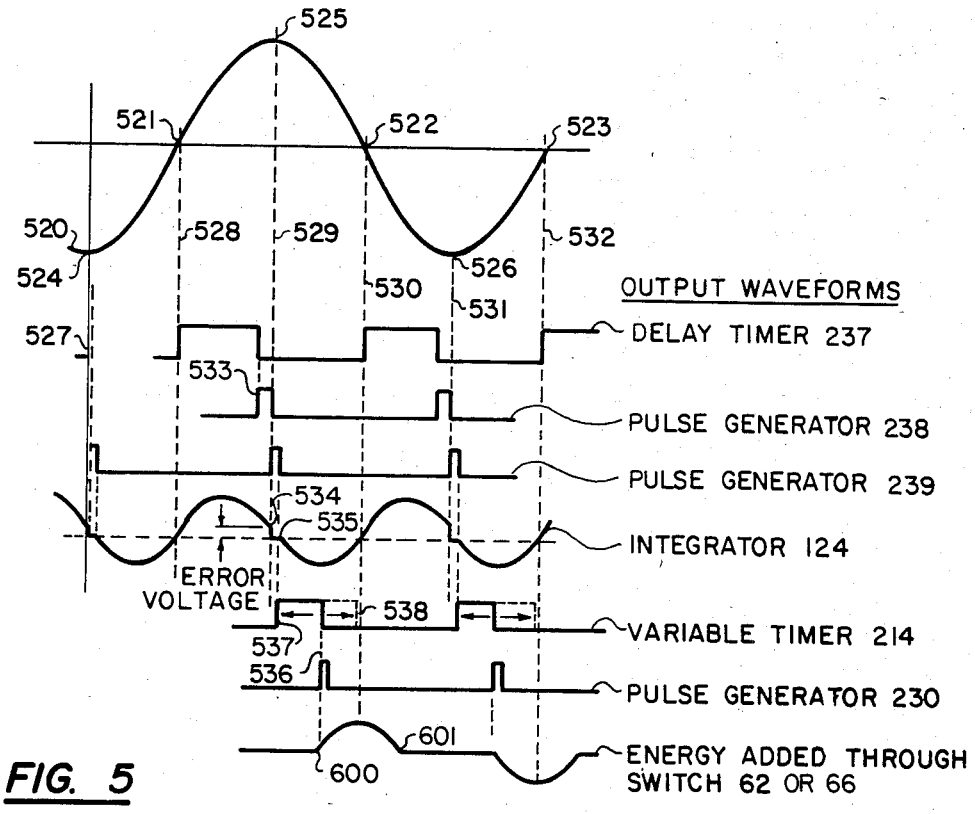
FIG. 5 is a diagrammatic illustration of a sensed waveform and the timing of operations performed by the voltage regulator.

FIG. 5 shows the timing relationship of the input sine wave and the outputs a various elements in the above-described circuits. Like numbers are used with reference to the description of FIG. 1. The curve 520 represents the input line voltage sinusoid with zero voltage crossings at 521, 522, and 523, and with peak voltages at 524, 525, and 526. The vertical lines 527–532 carry through the timing relationship of these line voltage points to the remaining curves in the figure. As shown, the output of the delay timer 237 rises in response to the cessation of current through zero crossing detector transistor 120 by rising at zero crossing points 521–523. As described above, the delay timer 237 is configured to time out after the elapse of slightly less than one-quarter of the period of the sine wave 520. Thus, the output of the timer 237 drops before the sine wave reaches its peaks at 525 and 526. The curve representing the output of the pulse generator 238 shows that the generator is triggered by the falling edge of the delay timer 237 output which causes its output to rise as illustrated at 533. The generator 238 is configured to time out at the peaks of the waveform 520 and thus falls back to its low level coincidently with the peaks 525 and 526 of the sinusoid. The waveform representing the output of the pulse generator 239 shows that the generator 239 is triggered by the falling edge of the pulse provided by the generator 238. Thus, the output of the pulse generator 239 rises at the peak points of the sine wave 520. Preferably, the pulse generator 239 is configured to provide a pulse of minimum width, the falling edge of which triggers the variable timer 214. The waveform curve representing the output of the integrating amplifier 124 illustrates a voltage waveform at the output of the integrator as it may appear when the input sine wave 520 is not at the predetermined level. As illustrated, at the time when the output of the pulse generator 238 drops, which opens the switch 130 and captures a sample of the integrator output on the capacitor 132, the output of the integrating amplifier 124 is not zero, and this deviation, labelled ERROR VOLTAGE, represents the error voltage which is stored on the sample-and-hold capacitor 132 at the time indicated by the line 534. The waveform at 535 indicates the end of the time-out period of the pulse generator 239 and it can be seen that the output of the integrating amplifier 124 is clamped and reset to zero at this time. Simultaneously with the resetting of the integrating amplifier 124, the output of the timer 214 rises which establishes the beginning of the timer's timing period. As illustrated, the output of the variable timer 214 drops at line 536. However, as explained above, the period of the pulse output by the timer 214 can be varied by variation of the reference voltage and by pre-charging the timing capacitor 218; this is illustrated by the arrows in the waveform representing the output of timer 214. Proper selection of component values, reference voltage levels, and pre-charging levels can vary the width of this pulse throughout the range defined essentially by the second and fourth quadrants of the sine wave 520. This is illustrated by the arrow defining the span between the line 536 and the pulse edge 537 and the arrow defining the span between the line 536 and the dotted pulse edge 537.

As described above, the pulse generator 230 is triggered by the falling edge of the output of the timer 214 to establish the time at which an activation signal is provided to one of the switches 62 and 66. The bottom waveform in FIG. 5 represents the operation of either of the switches 62 or 66. The curve shows how the switch is activated at 600 and how the current flowing through the switch rises from zero towards a peak occurring when the sine wave goes through zero voltage crossing 522 and then decreases towards zero at 601 of the sine wave. As described above, the sine wave locations 600 and 601 are correspondingly opposite points of the sine wave 520.

The apparatus described above has been presented with a train of delay and triggering pulses which result in initiating the output of the variable timer 214 at the 90° and 270° points of the input AC sine wave, and the timing diagram of FIG. 5 reflects this condition. However, it is to be understood that this specific timing relationship has been chosen only to simplify the description, and to convey the basic idea of the invention. Those skilled in the art will realize that under certain load conditions it may be necessary to enable either of the switches 62 and 66 prior to the peak of the input sine wave. For example, if the input voltage is very low, and energy is dispensed into the tank circuit 26 in the boosting direction, any load current flowing through the autotransformer windings 32 will oppose the boosting energy dispensed in the tank, and this will advance the zero current condition of the switch 62, effectively shortening the conduction period. To compensate for this load effect at an extremely low condition of the input voltage waveform, it will then become necessary to activate the switch 62 prior to the peaks of the input sine wave. Thus, this system can be optimized to accommodate a very wide range of input and load conditions by choosing suitable operating parameters for the fixed and variable timers. It should also be evident that dual control of the variable timer, that is, control which presets the timing capacitor in response to an error voltage and shifts the reference level in response to a load current, can be achieved with many other circuits which result in effective control of the output of the timer 214 by extension of reduction of its time out period.

It should also be obvious that the current sensing circuit can be modified to exhibit non-linear characteristics to achieve an optimized performance. For example, the divider network consisting of the resistors 263 and 264 can be modified with a diode/resistor network similar to the network 186. In addition, the error magnitude which is available on the line 207 can be utilized to control the gain of the amplifier 262 in a proportional relationship to achieve optimized compensation of load current effects. Any such modifications should be considered known technology which would be evident to anybody skilled in the art.

Figure 6:
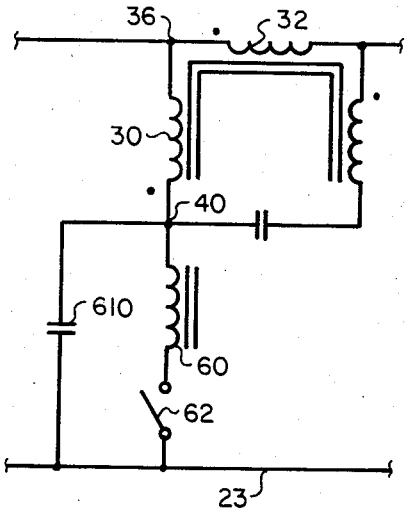
FIG. 6 is a schematic diagram of an alternate energy dispenser.
Figure 7:
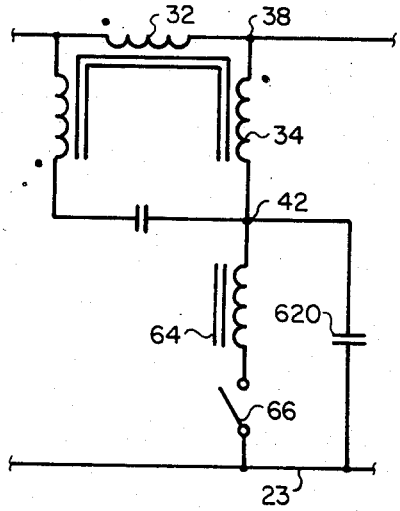
FIG. 7 is a schematic diagram of another alternate energy dispenser.

Reference to FIGS. 6 and 7 will aid the understanding of two variations of the switching circuit used to dispense energy in the tank circuit 26, but which required only a single switch operating unidirectionally.

In FIG. 6, a capacitor 610 has been added to the tank circuit 226 and connects to the tap of 40 in parallel with the inductive choke 60 and the semiconductor switch 62. Assuming that the input voltage level exceeds the predetermined level, the switch 62 will not be operated and no energy will be dispensed into the tank 26 through the choke 60. However, the capacitor 610 is connected to the autotransformer winding 30; therefore current will flow from the input port 20 through the winding 30 and through the capacitor 610 to the circuit common lead 23. The capacitor 610 and the autotransformer winding 30 now form a series resonant circuit which will oscillate at substantially the same frequency as the input AC line voltage. As long as the self-resonant frequency of the circuit comprising the autotransformer winding 30 and the capacitor 610 is higher than the frequency of the input AC line voltage, the resonating voltage, measured across the capacitor 610 with respect to the circuit common lead 23, will be larger than, and in phase with the input line voltage. Thus, if the voltage at the tap 40 is oscillating in phase with the input voltage, and at a larger amplitude than the input, the output of the autotransformer winding 32 will be less than the input voltage. Thus, with the capacitor 610 connected as shown in FIG. 6, the tank circuit 26 will produce a stepped-down output voltage as long as the switch 62 is not operated.

On the other hand, if the input line voltage is very much below the predetermined voltage level, the switch 62 will be triggered on by the above-described activation circuit so that the choke 60 will be placed in parallel with the capacitor 610, thereby cancelling the resonating effect of the capacitor 610 and terminating the winding 30 to the circuit common lead 23. Thus, as described above, causes a boost voltage to be induced into the winding 32, so that the voltage on line 46, with respect to the circuit common lead 32, will have a larger magnitude than the input voltage at the port 20. By controlling the conduction angle of the switch 62, it is possible to vary the operation of the autotransformer 28 over the full range from maximum buck to maximum boost.

The tank operation of the configuration illustrated in FIG. 7 is exactly opposite of that of FIG. 4. When the switch 66 is not operated, the capacitor 620 forms a resonant circuit with the series connected autotransformer windings 32 and 34. The oscillating voltage which appears across the capacitor 620 is larger than, and essentially in phase with the input voltage at the port 20. Inspection of the relative phasing of the windings 32 and 33 shows that the output voltage at the autotransformer tap 38 is now larger with respect to the circuit common lead 23 than the input voltage, that is to say, it is boosted. On the other hand, when the switch 66 is triggered by the activation circuit to conduct continuously, the energy dispensed through the choke 64 cancels the resonating effect of the capacitor 620 and causes a bucking voltage to be induced into the autotransformer winding 32 so that the output voltage available at the autotransformer tap 38 (with respect to the circuit common lead 23) is less than the input voltage at the input port 20. It should be evident that control of the conduction angle of the switch 66 from 0° to 360° conduction will make it possible to control the tank circuit 26 over the full range from maximum boost to maximum buck operation.

Figure 8:
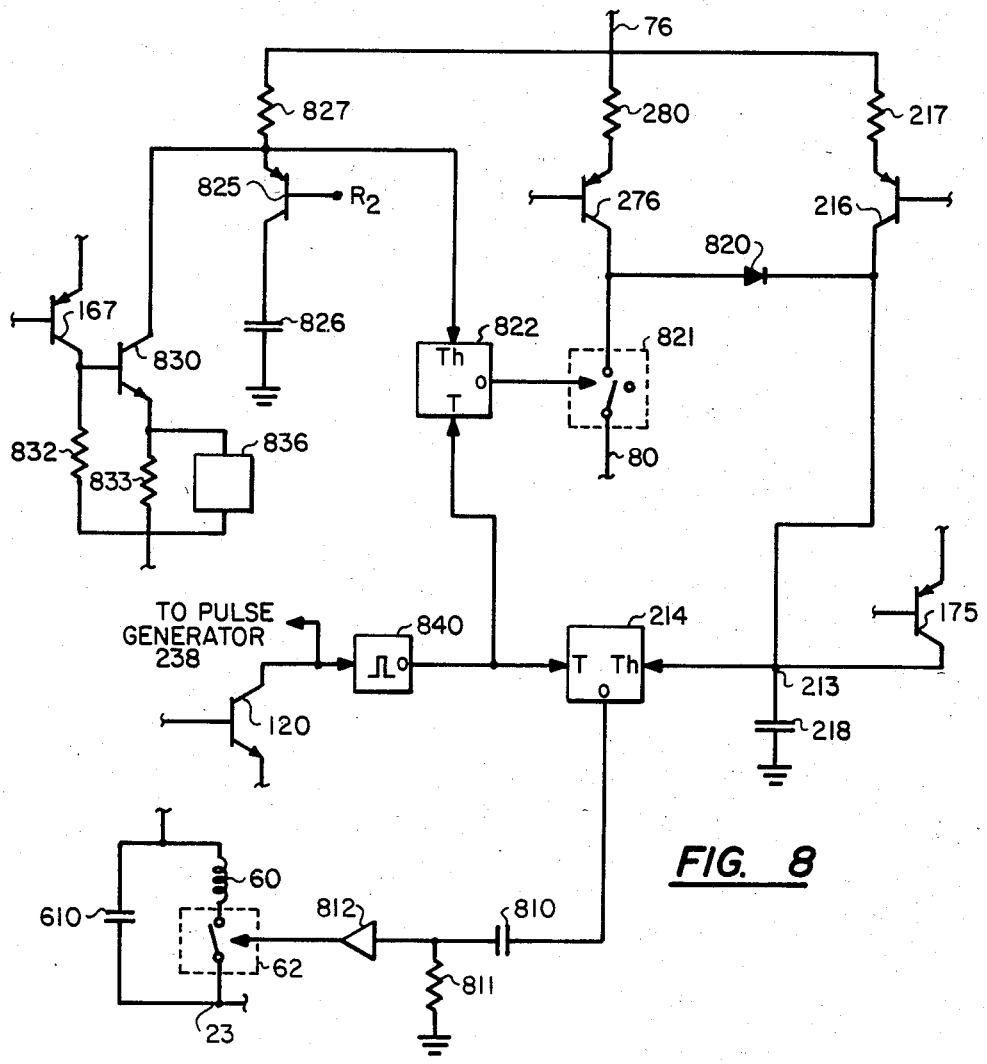
FIG. 8 is a partial schematic diagram of a circuit to control operation of the FIG. 6 energy dispenser.

A circuit for controlling the oscillatory circuit configuration of FIG. 6 is illustrated in FIG. 8. It will be appreciated that the circuit of FIG. 8 can be modified to provide corresponding control of the oscillatory circuit of FIG. 7. In FIG. 8, components corresponding to components illustrated in prior figures are indicated by the same reference numerals and have the same connecting as the identically-numbered components except as otherwise illustrated. The variable timer 214 provides an activation signal directly to the switch 62 through a differentiation circuit comprising a capacitor 810, a resistor 811 and an amplifier 812. The time-out threshold of the variable timer 214 is established, as above, by the slope of the current which charges the timing capacitor 218. The timing circuit for the capacitor is the result of the combination of currents flowing into the summation mode 213. One current is provided from the constant current source transistor 216, which operates as described hereinabove. Another current is obtained from the collector of the transistor 175. A third current is obtained from the collector of the transistor 276 through a diode 820. Also tied to the collector of the transistor 276 is a normally closed semiconductor switch 821 which is controlled by a second variable timer 822. The timer 822 can comprise an LM 555. The timing operation of the timer 822 is controlled by the timing network comprising a constant current transistor 825 and a charging capacitor 826. The current level through the transistor 825 is set by the resistor 827 which is connected between the emitter of the transistor and the positive voltage line 76. The charge on the capacitor 826 is fed to the threshold (Th) port of the timer 822 and when the capacitor charge exceeds an internally-set voltage threshold, the output of the timer 822 transitions from a high to a low state. The magnitude of the current which provides the charge to the timing capacitor 826 can be varied by provision of a current from the collector of the transistor 830 which is connected to amplify the collector current from the transistor 167. The operating point of the transistor 830 is set by the base resistor 832 and the emitter resistor 833 which is connected in parallel with another diode/resistor network 836. The operations of the variable timers 214 and 822 are triggered by provision of a pulse from a pulse generator 840 which is, in turn, triggered by the zero crossing detector transistor 120.

In operation, the zero crossing detector transistor 120 operates as described hereinabove to detect zero crossings of the input sinusoidal voltage and triggers the pulse generator 238 to begin the above-described series of sampling and discharging operations. In addition, the transistor 120 triggers the pulse generator 840 to provide a relatively narrow output pulse for triggering the timers 214 and 822. With no other charging currents flowing into the node 213, the timing network of the timer 214 is designed to cycle the output of the timer 214 at the next following zero crossing so that closure of the switch 62 will dispense no energy into the oscillatory tank circuit 26. Stated differently, the timing network of the timer 214 will provide a timing cycle substantially equivalent to one-half period of the input line voltage sine wave. For a typical 60 Hz sine wave, this timing period would be approximately 8.1 milliseconds.

The timer 822 is designed to have an operation period of substantially less than the half period of the input line voltage sine wave; preferably, for 60 Hz input voltage sine wave, the timing network of the timer 822 outputs a one millisecond-wide pulse.

Figure 9:
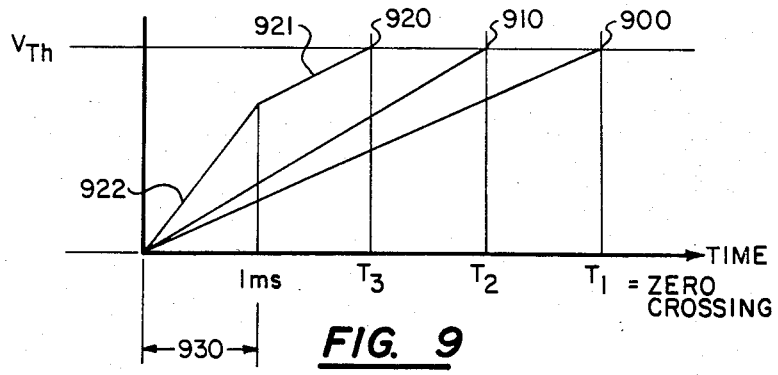
FIG. 9 shows waveforms illustrating timing operations of the FIG. 8 circuit.

A described above, the base of the transistor 175 is connected to receive from the voltage sensing circuit a current representative of the difference between the preset voltage level and the line voltage level. In the FIG. 8 circuit, this current is amplified by the transistor 175 and summed with the current from the transistor 216 to charge the timing capacitor 218. For the circuit of FIG. 6, the preset voltage level will be set at substantially the upper end of its range so that the only voltage error which will be sensed and amplified by the transistor 175 will be one where the line voltage level drops below the preset level. As explained hereinabove, when the line voltage level drops below the preset level, energy is dispensed into the oscillatory tank circuit 26 in a boosting direction through the action of the switch 62. Thus, the detection of a voltage error will cause the transistor 175 to provide a current corresponding to the measured error to the capacitor 218. The effect of providing the additional current is illustrated in FIG. 9. In FIG. 9, the charging waveform 900 represents the build-up of voltage on the capacitor 218 when the capacitor is receiving current only from the current source transistor 216. As illustrated, the rate of charge accumulation will cause the timer 214 to time out at time $T_1$ which corresponds to a zero crossing point of the input sine wave. As explained above, operation of the switch 62 at this point will result in the provision of no charging energy into the oscillatory tank circuit, with the result that the line voltage level will be bucked by the oscillations caused by capacitor 610. When the line voltage level drops below the preset level, the voltage error is translated to a charging current by the transistor 175 with the result that the slope of the charge build-up on the capacitor 218 is increased, causing the timer 214 to change states before the zero point. This is represented by the voltage charge slope waveform 910 which causes the timer 214 to time out at time $T_2$. Effectively, this advances the operation of the switch 62 and causes the choke 60 to dispense a proportionate amount of energy in a direction which initially cancels the oscillations caused by the capacitor 610 and ultimately induces ringing in a boosting direction, the magnitude of which depends upon the conduction angle of switch 62.

When a load current is drawn from the regulator and flows between the ports 20 and 58, the magnitude of the current will be sensed and measured as described hereinabove, with the measured magnitude provided as a voltage to the base of the transistor 276. The voltage, in turn, induces a current to flow in the transistor 276 which is proportional to the magnitude of the load current which is measured by the load current sensing circuit described above. The collector current from the transistor 276 is steered by the action of the switch 821 either to the charging capacitor 218 or through the switch 821 to the negative voltage line 80. The switch 821 is designed to be normally on so that the diode 820 is reverse biased and the collector current from the transistor 276 is diverted away from the charging capacitor 218. However, the variable timer 822 is operated at the zero crossing of the input line voltage for a period of time substantially less than a half period of the input voltage sine wave. Thus, for preferred operation, the timer 822 will open the switch 821 for substantially one millisecond, during which time the diode 820 will cause current to flow from the collector of the transistor 276 to the charging capacitor 218. The resulting charging waveform, indicated by 920 in FIG. 9, has an initial steep slope 922 for one millisecond and then, when the switch 821 is again closed at the end of the time-out period of the timer 822, the slope of 921 of the charging waveform is reduced by the diversion of the transistor 276 current away from the charging capacitor 218. This effectively advances the transition of the output of timer 214 to time $T_3$. Thus, as described above, the drawing of a load current will advance the time-out of the timer 214 and the provision of an activation signal to the switch 62.

As with the timer 214, the time-out threshold of the timer 822 can be delayed when the transistor 830 is switched on to divert a portion of the emitter current from the transistor 825, thus reducing the charging current available to the capacitor 826. This will occur only during the condition where the level of the line voltage falls beneath the preset level, because the measured voltage error is provided as an input to the base of the transistor 167. Thus, when the line voltage level drops, the transistor 167 will be turned on to conduct a proportionate amount of current which induces a corresponding voltage on the resistor 832. The voltage on the resistor 832 will turn the transistor 830 on, with the operating level of the transistor determined by the amount of measured voltage error. Thus, when the transistor 830 is turned on, it will extend the time-out period of the timer 822 beyond the preferred one millisecond which will, in turn, cause current to be diverted from the transistor 276 to the timing capacitor 218 for a corresponding amount of time. This will maintain the steep slope 922 for a period beyond the preferred one millisecond, cause the timer 214 to time out sooner, and advance the firing angle of the switch 62. Consequently, more energy will be dispensed through the choke 60 resulting in a higher level for the adjusting voltage which is induced on the winding 32.

Figure 2:
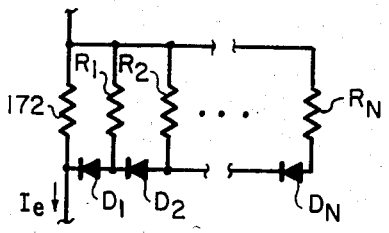
FIG. 2 is a partial schematic diagram of a diode/resistor network used in the line voltage regulator of the invention to impose an non-linear characteristic on the measured error between the sensed voltage level and the predetermined voltage level.

Those skilled in the art will note that transistors of the circuits illustrated in FIGS. 1 and 2 have an emitter-base forward voltage when they are conducting, and that this voltage changes as the function of current and temperature. Customarily, compensating semiconductor devices are used to achieve optimized performance over the wide range of temperatures and operating voltages. Any such compensating components have been purposely omitted in the description of the apparatus of the invention in order to more clearly convey the novel concept. Similarly, almost any resistor illustrated in FIGS. 1–3 could be made variable for optimized circuit performance, and many integrated circuits are available which may combine individual circuit functions as this apparatus. Also, it should be evident that the operation performed by the voltage error sensing circuit of the apparatus can easily be performed with reference to the voltage obtained at the output port 58 and a feedback loop configuration, which would require only minor modifications of the described apparatus. For example, a manually operated switch, not shown, can connect the resistor 89, and, therethrough, the voltage sensing circuit to either part 20 or part 58 to regulate against an error voltage obtained by measuring the difference between the reference voltage and either the input or output AC voltage, respectively. Finally, it should be evident that very precise regulation of the line voltage can be achieved by feeding the sampled voltage error from the diode bridge 141 back to the non-inverting input of one integrating amplifier 124, thereby integrating any error into the following sample.

Thus, having fully described my invention, I claim:

1. An apparatus for regulating an AC voltage, comprising:

an input port for connecting to a source of input AC voltage;

an output port for delivering a regulated load voltage and a load current to a load;

oscillatory tank circuit means connected between said input and output ports for being activated to produce an AC adjustment voltage and for combining said AC adjustment voltage with said input AC voltage;

first sensing means responsive to a zero crossing of an input AC voltage connected to said input port for measuring the difference in magnitude and polarity between the level of said input AC voltage and a predetermined voltage level and for providing a first difference signal representative of said magnitude difference and a second difference signal representative of said polarity difference;

variable trigger means responsive to said first difference signal and to said zero crossing for providing an activation signal at a time after said zero crossing determined by said first difference signal; and switched tank circuit activating means responsive to said second difference signal and to said activation signal for activating said oscillatory tank circuit means to produce an AC adjustment signal having a magnitude determined by the time when said activation signal occurs after said zero crossing and having a phase of oscillation with respect to said input AC voltage determined by said second difference signal.

2. The apparatus of claim 1 further including a second sensing means responsive to a load current flowing to said output port for providing a load current magnitude signal representative of the magnitude of said load current and wherein said variable trigger means is responsive to the combination of said first difference and said load current magnitude signals for providing said activation signal at a time after said zero crossing determined by said combination.

3. The apparatus of claim 2 wherein said variable trigger means comprises a variable timer having a timing trigger threshold determined by said load current magnitude signal and a timing trigger ramp signal that rises to said threshold from an initial level determined by said first difference signal.

4. The apparatus of claim 3 further including shaping circuit means for adjusting characteristics of said first difference signal in a predetermined manner to correspond to characteristics in said input AC voltage.

5. The apparatus of claim 1 wherein said switched tank circuit activating means includes a gate circuit responsive to said activation and said second difference signals for providing a first or second switch signal, and a pair of switches, each of said switches being closed by a respective one of said switch signals for providing an AC conductive path between said oscillating tank circuit means and an AC common potential.

6. The apparatus of claim 1 wherein said oscillatory tank circuit means includes an auto transfer having a first winding connected in series between said input and output parts, a second winding connected to said switched tank circuit activating means for inducing AC adjustment voltage oscillation in a first direction with respect to said input AC voltage, and a third winding connected to said switched tank circuit activating means for inducing AC adjustment voltage oscillation in a second direction with respect to said input AC voltage.

7. The apparatus of claim 6 wherein said switched tank circuit activating means includes a gate circuit responsive to said activation and said second difference signals for providing a first or second switch signal, and a pair of switches, each of said switches connected between a respective one of said second or third windings and closed by a respective one of said switch signals for providing an AC conductive path between said respective one of said second or third windings and an AC common potential.

8. The apparatus of claim 6 wherein said switched tank circuit activating means includes a gate circuit responsive to said activation and said second difference signals for providing a first or second switch signal, a switch and an inductor connected in series between a respective one of said second or third windings and an AC common potential and a capacitor connected in parallel with said switch and inductor, and said switch is closed by a respective one of said switch signals for providing an AC conductive path between said respective second or third winding and said AC common potential and for shunting said capacitor.

9. A method for regulating an input AC voltage with an apparatus including an input port for connecting to a source of an input AC voltage, an output port for providing a regulated AC voltage and an oscillatory tank circuit means for producing an adjustment AC voltage and combining said adjustment AC voltage with said input AC voltage to produce said regulated AC voltage, including the steps of:

measuring differences in magnitude and polarity between an input AC voltage and a predetermined reference voltage level in response to a zero crossing of said input AC signal;

generating an adjustment signal at a time after said zero crossing that corresponds to said measured magnitude difference; and inducing an adjustment AC signal in said oscillatory tank circuit means having a magnitude corresponding to said time and a polarity of oscillation with respect to said AC input signal determined by said measured polarity difference.

10. The method of claim 9 further including measuring the magnitude of a load current flowing to said output port and wherein said generating step includes generating said adjustment signal at a time after said zero crossing determined by the combination of said measured magnitude difference and said measured load current magnitude.

* * * * *